US007736711B2

(12) United States Patent
Dobelle

(10) Patent No.: US 7,736,711 B2
(45) Date of Patent: Jun. 15, 2010

(54) ARTICLE FOR PREVENTING ITEMS FROM FALLING BEHIND FURNITURE

(76) Inventor: Howard A. Dobelle, 2100 Linwood Ave., Apt 20W, Fort Lee, NJ (US) 07024

( * ) Notice: Subject to any disclaimer, the term of this patent is extended or adjusted under 35 U.S.C. 154(b) by 0 days.

(21) Appl. No.: 12/321,007

(22) Filed: Jan. 15, 2009

(65) Prior Publication Data

US 2009/0199390 A1 Aug. 13, 2009

Related U.S. Application Data

(63) Continuation of application No. 11/300,970, filed on Dec. 14, 2005.

(51) Int. Cl.

| | |
|---|---|
| ***B29D 22/00*** | (2006.01) |
| ***B29C 47/00*** | (2006.01) |
| ***A47D 15/00*** | (2006.01) |
| ***A47B 67/02*** | (2006.01) |
| ***A47F 5/08*** | (2006.01) |
| ***A47F 5/00*** | (2006.01) |

(52) U.S. Cl. ..... 428/34.1; 428/36.9; 297/182; 312/246; 312/247; 211/86.01; 211/87.01; 211/90.01

(58) Field of Classification Search ..... 428/36.9, 428/34.1; 312/246, 247; 211/86.01, 87.01, 211/90.01; 297/182

See application file for complete search history.

(56) References Cited

U.S. PATENT DOCUMENTS 5,518,309 A * 5/1996 St-Pierre ..... 312/140.4

7,140,206 B2 * 11/2006 Braun et al. ..... 68/3 R

OTHER PUBLICATIONS

Definition of Furniture; Compact Oxford English Dictionary; http://www.askoxford.com/concise_oed/furniture?view=uk; 2009.*

* cited by examiner

*Primary Examiner*—Rena L Dye
*Assistant Examiner*—James Yager
(74) *Attorney, Agent, or Firm*—Michael E. Zall

(57) ABSTRACT

The device prevents the loss of articles otherwise susceptible to falling behind furniture, appliances, fixtures or equipment or other large objects placed next to a wall which are not easy to move or reach under such as, but not exclusively, couches, wardrobes, desks, washers, dryers, refrigerators, filing cabinets and dressers. The compressible and flexible device is fitted from above into the crevice between the furniture and the wall. It is held in place by friction created by the pressure caused by the deformation of the device between the furniture and wall. The device, when flexed or compressed, creates a u-shaped channel which catches valuables such as jewelry, makeup, currency, papers, office supplies or other items which are left on top of furniture and which without such invention, may otherwise fall behind the furniture where it would be difficult or impossible to retrieve. Because it uses pressure and friction to maintain its placement, the article does not require fastening by means to the wall or furniture, so it does not damage the furniture or wall. Objects which are caught in the device can be removed easily by the user with the need to remove the article from the crevice.

3 Claims, 3 Drawing Sheets

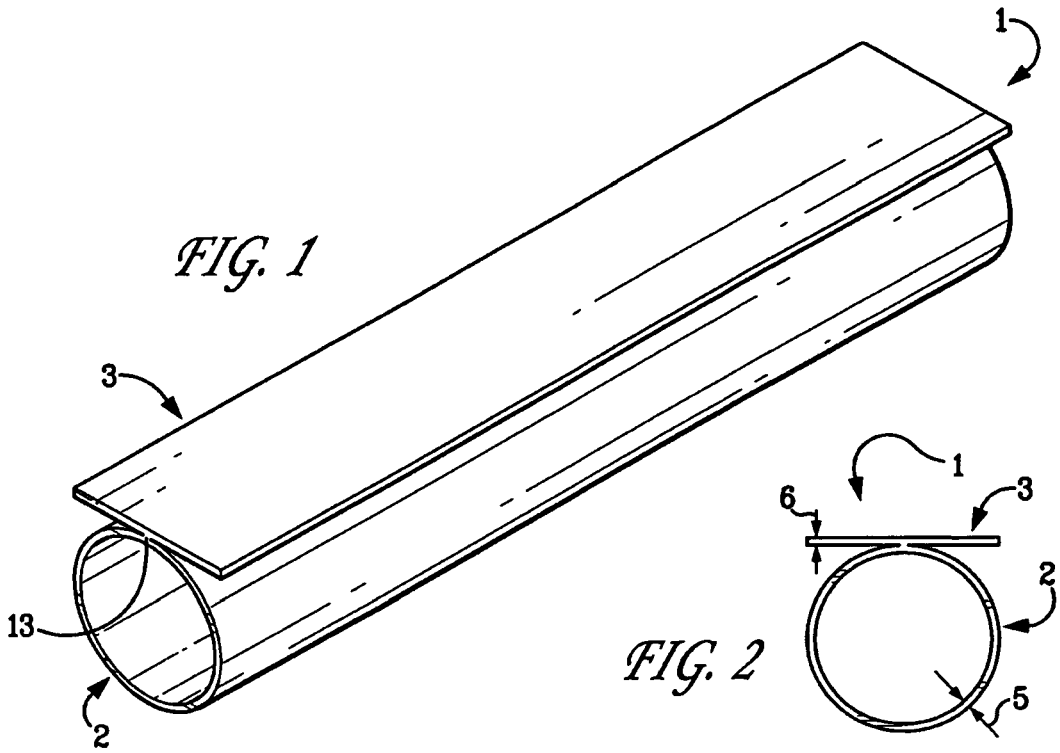
FIG. 1
FIG. 2
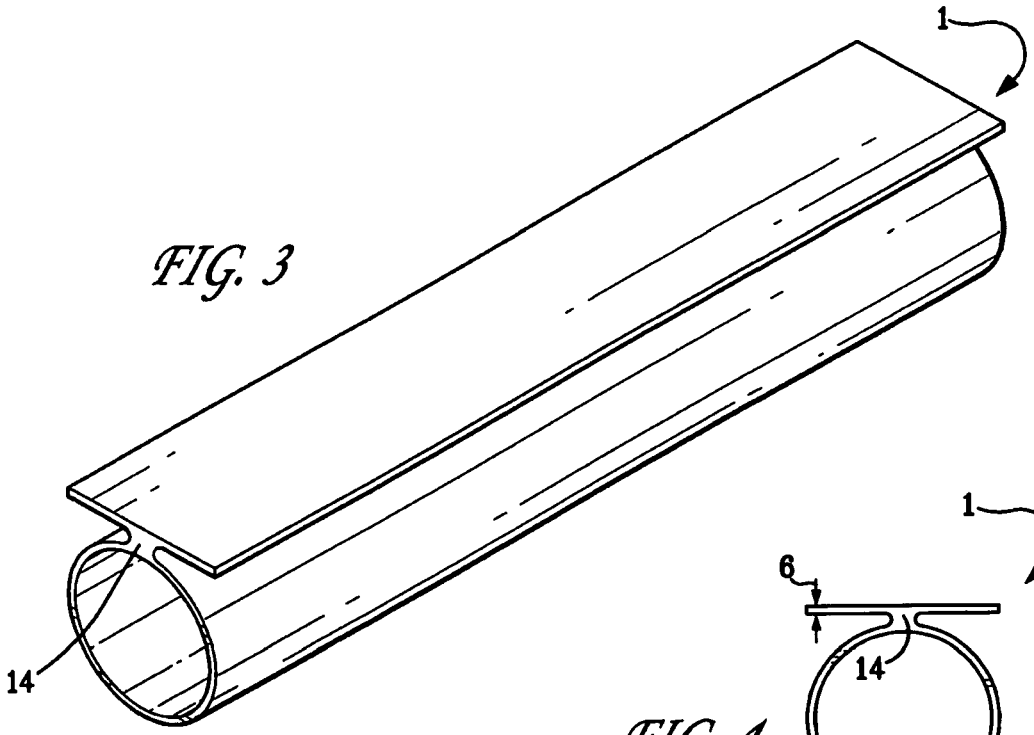
FIG. 3
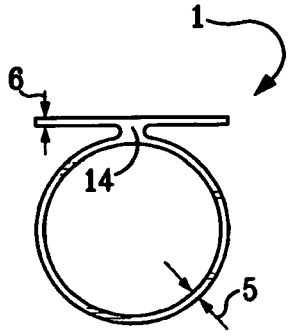
FIG. 4

ARTICLE FOR PREVENTING ITEMS FROM FALLING BEHIND FURNITURE

RELATED APPLICATIONS

This is a continuation of U.S. Ser. No. 11/300,970 filed on Dec. 14, 2005 which is now pending

BACKGROUND OF THE INVENTION

1. Field of the Invention

The present invention relates to a device for catching items susceptible to falling behind furniture, appliances, fixtures or equipment, or into any other crevice which would cause the item to become lost or irretrievable. More specifically, the present invention is concerned with a device for catching valuables such as jewelry, makeup, currency, papers, office supplies or other items which are left on top of furniture and which, without such invention, may otherwise fall behind the furniture where it would be difficult or impossible to retrieve.

2. Brief Description of the Prior Art

In a bedroom or other room in the home, where there are large pieces of furniture in use, items are often stored or temporarily placed on the top of the surfaces of the furniture. This furniture never fits completely or tightly against the wall or against other furniture next to which it is placed. This allows a gap or crevice through which the items on top of the furniture may fall. The clearance width may be relatively small, but even so, it becomes a natural trap for misplaced items, which may include valuables such as jewelry, makeup, currency, papers, office supplies or other items which are left on top of furniture even garbage which may be placed on the top surface. Such things migrate into the confined space beneath and behind the furniture, where retrieval can be difficult or impossible for extended periods of time. The area behind the furniture is usually difficult to access.

A vacuum cleaner with a nozzle attachment may be able to reach into a limited part of some (but not all) of these spaces, and may afford a limited means heretofore available for retrieval of some lost items from behind the furniture. However, a vacuum cleaner cannot reach behind or under many types of furniture. In addition, a vacuum cleaner cannot pick up.

Ultimately, in order to recover most fallen valuable items without damage, the furniture must, in most cases, be displaced particularly for furniture under which vacuum attachments cannot reach, or for valuable items which are not desired to be sucked into a vacuum cleaner. This is time-consuming and requires physical strength. Displacement of the furniture can even cause injury to the owner or even damage to the floor on which it is slid or the wall against which it rests.

Only one patent in the prior art addresses the prevention of the loss of valuable items behind another object. St-Pierre (U.S. Pat. No. 5,518,309) discloses a metal mesh basket as the catching device. The metal mesh basket is designed to fit between a washer or dryer and the wall behind either machine. It is required to be attached by screws or other fastening devises directly to the washer or dryer. This requires drilling holes or otherwise permanently altering the washer or dryer. This is not advantageous, useful or practical for furniture which may be expensive and which its owner is thus hesitant to alter.

The prior art discloses items of different cross-sectional configurations, positioning mechanisms and securing means then is required by the present invention. Each of these devices use some form of attachment means or toothed edges to secure the device in its location for use. These features are not required by the present invention.

The unique characteristics and operative features of the device of the present invention are, therefore, unrepresented within the prior art. The prior art is outdated in general and unresponsive with respect to any ability to address the concerns of the present invention. The prior art is unable to achieve the results of the present invention without damage to the furniture due to the required attachment means. The device of the present invention is designed to address such concerns in a unique and efficient manner, using techniques and principles not currently shown or disclosed in the prior art.

OBJECT OF THE INVENTION

An object of the present invention is therefore to solve the above discussed problems, e.g. items falling behind furniture or the like, by providing a device capable of catching items before they fall to the floor behind a piece of furniture or into a crevice and thereby becoming irretrievable.

SUMMARY OF THE INVENTION

In accordance with the present invention, there is provided an article for catching items susceptible to falling behind furniture or into a crevice. The furniture typically has a top portion upon which items may be placed and a rear portion facing and spaced apart from a wall standing behind the furniture. The article comprises an object catching means. The object catching means is designed to fit between the rear portion of the furniture and the wall standing behind the furniture, whereby objects susceptible to falling behind the furniture are caught by the object catching means, thereby preventing loss. The owner can then reach and retrieve such items without the need of removing the device or moving the furniture.

According to the preferred embodiment of the present invention, the object catching article consists of a resilient, compressible body, and a tangentially integrated or attached flexible fin. The resilient compressible body may be of any tubular shape. However, a circular cross-section is preferred. The flexible fin should preferably be long enough to cover the full length of the crevice between the wall and the rear portion of the furniture or other object. The compressible body need not continue the entire length of such crevice, provided there is sufficient contact between the compressible body and the wall to create the desired holding effect and support the flexible fin.

The flexible fin, provides a means for catching objects which would otherwise, but for the device, become displaced from the top surface of the furniture and fall behind furniture and the like, whereby the objects become difficult to retrieve. The flexible fin may be made from any thin and flexible material which would flex and form a channel when pressure is applied to the edges of the fin as the compressible body is fit behind the furniture during use.

Depending on the type of manufacture, the flexible fin may be integrated or permanently attached to the resilient compressible body. If extrusion is used, it is preferred that the fin be integrated with the resilient compressible body. Alternatively, the fin may be attached to the compressible body by heat welding, adhesive, chemical bonding, or mechanical attachment means.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

FIG. 1 is a perspective view of the device for catching items which fall behind furniture with one form of attachment between the compressible body and the flexible fin;

FIG. 2 is an end view of the Article of FIG. 1;

FIG. 3 is a perspective view of another device for catching items which fall behind furniture with another form of attachment between the compressible body and the flexible fin;

FIG. 4 is an end view of the Article of FIG. 3;

DETAILED DESCRIPTION OF THE INVENTION

Although the preferred embodiments of the present invention will be described in the following description with reference to valuable items, such as jewelry, makeup, currency, papers, office supplies, and other items which may become lost between a piece of furniture or other object and a wall behind such furniture or object, it will readily appear to those skilled in the art that the concept of the invention can also be used to catch a multitude of other objects which are susceptible to fall in other crevices created by other types of furniture or even appliances, equipment, fixtures, walls and other large objects.

Figure 7:
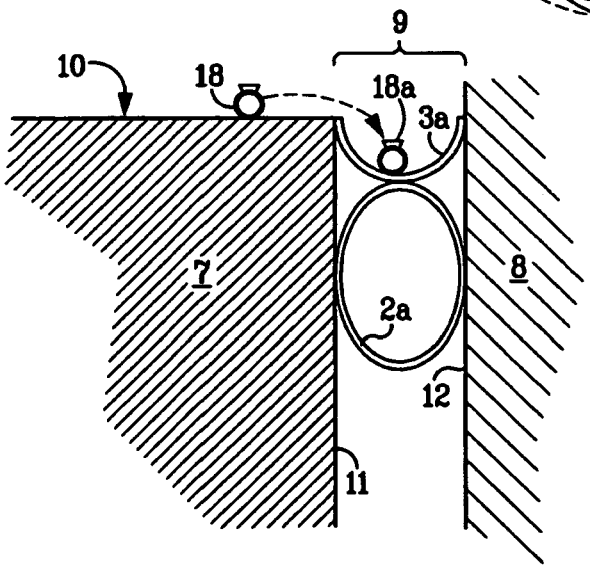
FIG. 7 is an end view of the device for catching items which fall behind furniture as it would appear when ready and in use between a piece of furniture and a wall.
Figure 8:
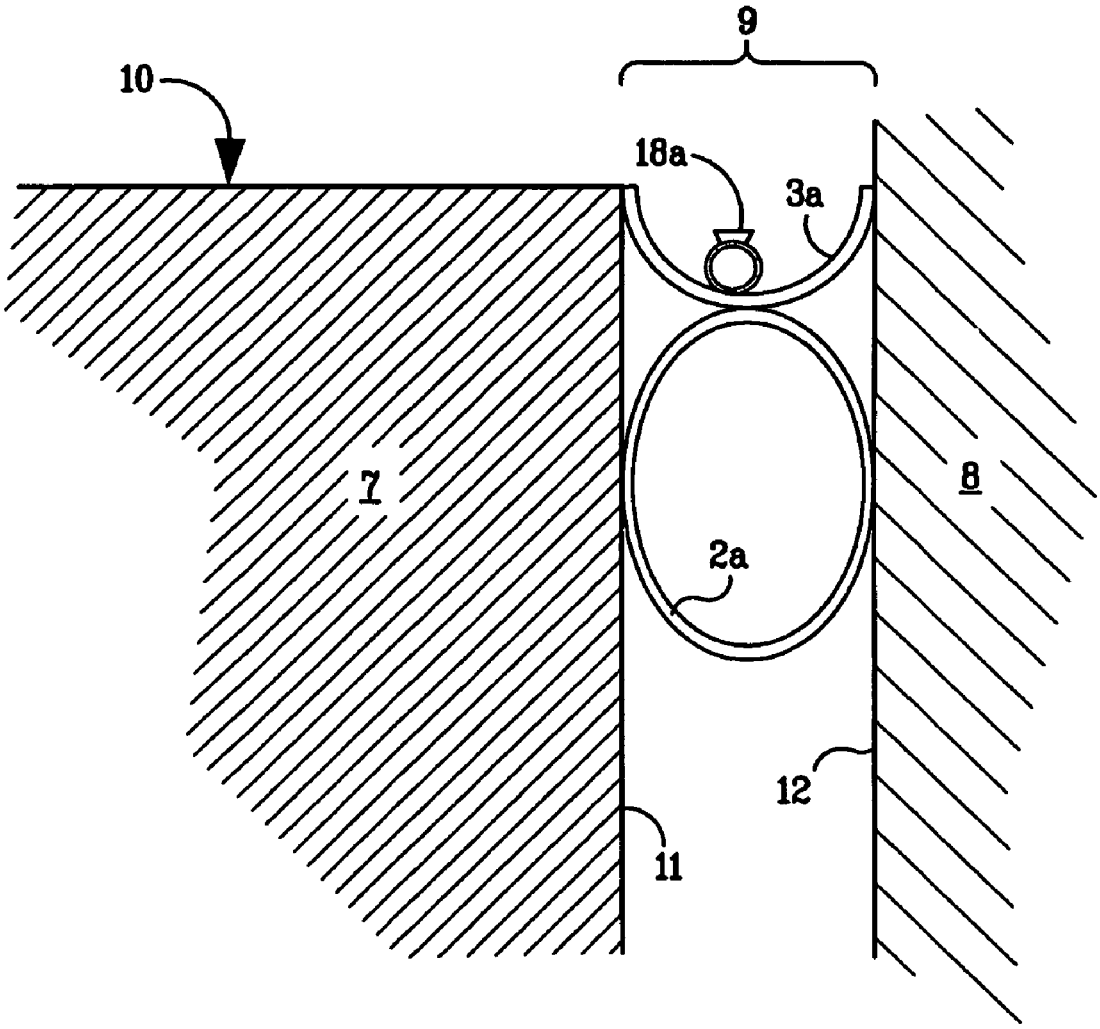
FIG. 8 is an end view of the device for catching items which fall behind furniture as it would appear after catching an item while between a piece of furniture and a wall.

As shown in FIGS. 7 and 8 and in accordance with the present invention, there is provided an article for catching items 18 susceptible to falling behind furniture 7 next to a wall 8 or into a crevice 9. The furniture 7 typically has a top portion 10 upon which items 18 may be placed and a rear portion 11 facing and spaced apart from a wall 8 standing behind the furniture 7. The article comprises an object catching means 1. The object catching means 1 is designed to fit between the rear portion 11 of the furniture 7 and wall 8 standing behind the furniture 7, whereby items 18 susceptible to falling behind the furniture 7 are caught 18*a* by the object catching means 1.

FIGS. 1 thru 4 show the preferred embodiment of the present invention. In FIG. 1 the object catching means 1 consists of a resilient, compressible body 2, a flexible fin 3 and a means of attachment 13 between the compressible body 2 and the flexible fin 3. The resilient compressible body 2 may be of any elongated shape, but tubular, with a circular cross-section, is preferred.

In FIG. 2, the cross section 5 should be of such thickness as to give resiliency against the compressive forces experienced by the article during use and thus creating friction between itself and the wall 8 and the rear portion 11 of the furniture 7.

The flexible fin 3, when in a relaxed or unsprung state, should be flat and attached tangentially to the compressible body 2. The material and thickness 6 of the flexible fin should be such that, during use, the flexible fin 3 flexes to create a channel or trough which maintains contact with both the wall 8 and the rear portion 11 of the furniture 7.

The means of attachment 13, between the flexible fin and compressible body, may be any mechanical, chemical, or any other means and serves to maintain a permanent connection between the compressible body 2 and the flexible fin 3. The means of attachment 13 should remain pliant as the article 1 is taken in and out of use (as shown in FIGS. 5 and 6), thus subjecting the attachment means 13 to stress from the flexing of the flexible fin 3 and the compressible body 2.

FIGS. 3 and 4 show the article 1 as a single unitary body as would be created by an extrusion process. The general shape is maintained where there is a lower tubular compressible body and an upper flexible fin tangential to the body. The neck 14 formed by the interface of the fin and body is known in the art of plastic extrusion and need not be described in detail. Similarly, the thickness 6 and the cross section 5 should be sufficient to maintain durability as well as allow flexibility during use.

The flexible fin 3 should preferably cover the entire length of the crevice between the wall 8 and the rear portion of the furniture 11. The compressible body 2 need not continue the entire length of such crevice. There need only be sufficient contact between the compressible body 2, the wall 8 and rear furniture face 11 to create the desired holding effect and support the flexible fin without the need to fasten to the wall 8 or furniture 7.

Figure 5:
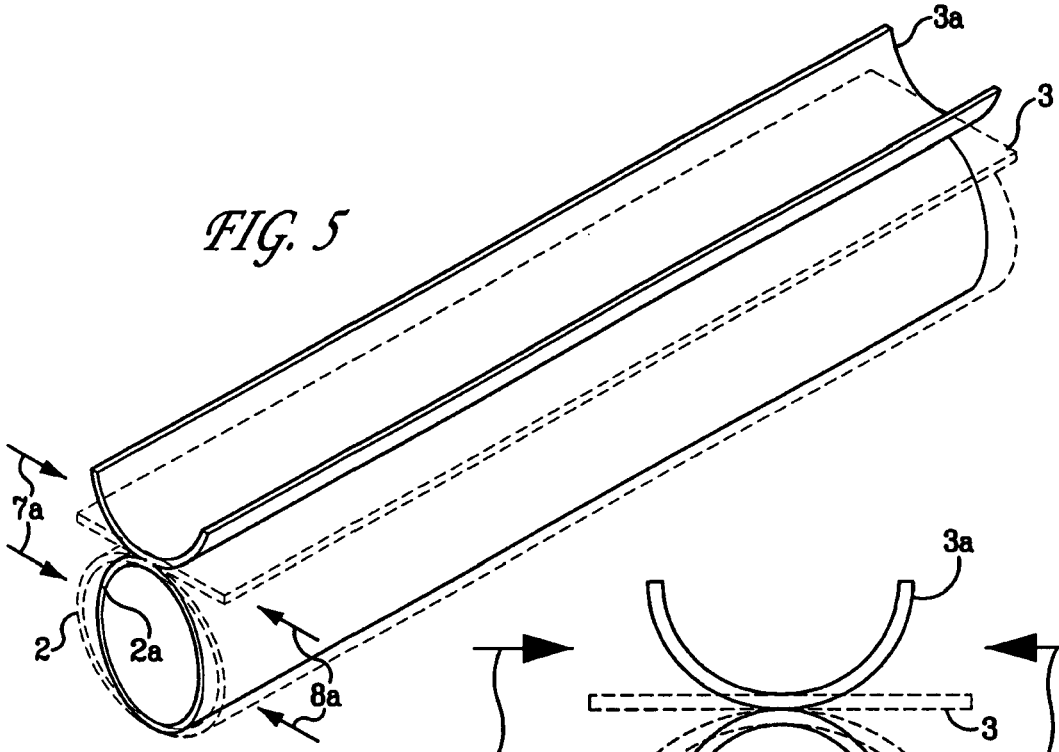
FIG. 5 is a perspective view of the device for catching items which fall behind furniture in a deflected state.
Figure 6:
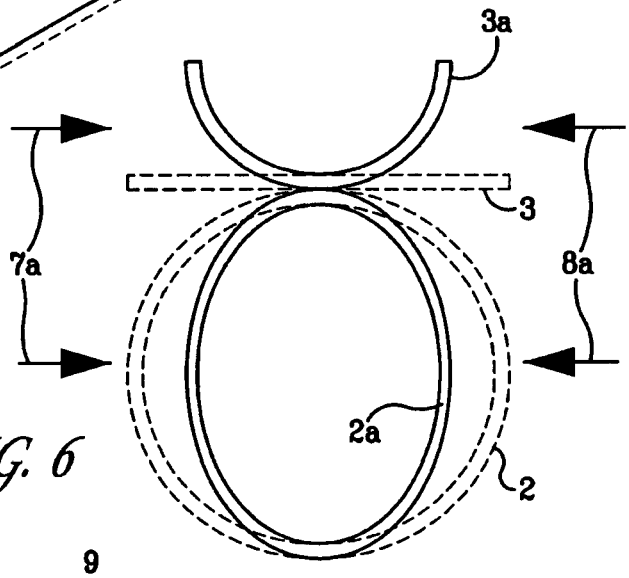
FIG. 6 is an end view of the device for catching items which fall behind furniture in a deflected state.

FIGS. 5 and 6 indicate the direction of the forces 7*a* and 8*a* on the article 1 and the flexing undergone during use. The force required is a function of the thickness 6 and cross section 5 of the article 1 and the spring constant of the material used. Forces 7*a* and 8*a* are equal but opposite forces and result from flexing of the article 1 as it is inserted in a crevice 9 created by a piece of furniture 7 and a wall 8. As the article 1 experiences forces 7*a* and 8*a* during use, the article 1 flexes from relaxed or unsprung state 2 and 3 to a flexed or sprung state 2*a* and 3*a*. When forces 7*a* and 8*a* are removed, the article 1 will return to its relaxed or unsprung state 2 and 3. It is this spring tension that holds article 1 in place during use so as to catch objects as they move from 18 to 18*a*. Thus no mechanical attachment is required between the article 1 and either the wall 8 or the rear portion 11 of the furniture 7. Therefore, article 1 may be removed and replaced from the crevice 9 at anytime. However, in most cases, the objects 18*a* may be removed from the article 1 without the need to remove article 1 from the crevice 9.

FIGS. 7 and 8 show the article 1 as it would appear when in use between a wall 8 and the rear portion 11 of furniture 7. The space between the rear portion 11 of the furniture 7 and the wall creates a crevice 9. The article 1 should be of such size to permit insertion into crevice 9 without plastic deformation. However, the crevice 9 should be narrow enough to create some flexing of the article 1 as it is inserted to cause it change from its natural state 2 and 3 to its flexed state 2*a* and 3*a*.

The article 1 may be produced in different lengths, thickness 6 and cross-section 5, so it can be used for different ranges of sizes of crevice 9.

The invention is described in detail with reference to a particular embodiment, but it should be understood that various other modifications can be effected and still be within the spirit and scope of the invention. It should also be understood that reference has been made to furniture and a wall, and it can be appreciated by those skilled in the art that substitution of other objects for either the wall or the furniture can be made and remain within the spirit of the intended use of the invention.

What is claimed is:

1. A method of using an article for removable insertion into a crevice formed by a rear surface of a furniture piece placed against a wall, the crevice formed by the wall and the rear surface facing the wall, the furniture piece having a top surface upon which articles are placed and the wall extending above the top surface of the furniture, the method comprising:

a) providing an article comprising:

a flexible, resilient and compressible unitary tubular member having an exterior surface and a length;

a tangential flexible, resilient fin fixedly mounted to the exterior surface along a portion of the length of the tubular member, wherein the tubular member and fin form an integral structure; the fin having opposed flexible longitudinal edges;

b) inserting the article into the crevice between the rear surface of the furniture and wall, the tubular member and longitudinal edges of the fin are compressed between the wall and rear surface of the furniture to frictionally and springedly maintain the article therebetween, the longitudinal edges of the fin maintaining contact with the wall and rear surface of the furniture creating an upward facing channel below the top surface of the furniture to catch loose articles falling from the surface of the furniture into the crevice.

2. The method of claim 1, wherein the tubular member is a cylinder.

3. The method of claim 1, wherein the fin is fixedly mounted to the exterior surface along the total length of the tubular member.

* * * * *